US009010412B2

(12) United States Patent
McGuire

(10) Patent No.: US 9,010,412 B2
(45) **Date of Patent: *Apr. 21, 2015**

(54) BALL DROP WELLHEAD CONTROL APPARATUS

(75) Inventor: Bob McGuire, Meridian, OK (US)

(73) Assignee: Oil States Energy Services, L.L.C., Houston, TX (US)

( * ) Notice: Subject to any disclaimer, the term of this patent is extended or adjusted under 35 U.S.C. 154(b) by 654 days.

This patent is subject to a terminal disclaimer.

(21) Appl. No.: 13/331,903

(22) Filed: Dec. 20, 2011

(65) Prior Publication Data

US 2013/0153237 A1 Jun. 20, 2013

(51) Int. Cl.
*E21B 43/12* (2006.01)
*F16L 55/46* (2006.01)
*E21B 33/05* (2006.01)

(52) U.S. Cl.
CPC ..... *E21B 33/05* (2013.01)

(58) Field of Classification Search
USPC ..... 166/193, 75.15, 284; 137/15.07, 137/625.46, 625.47; 15/104.062
See application file for complete search history.

(56) References Cited

U.S. PATENT DOCUMENTS 3,039,531 A * 6/1962 Scott ..... 166/70
3,218,659 A * 11/1965 Rowley ..... 15/104.061
3,721,265 A 3/1973 Hoffland
3,821,968 A 7/1974 Barb
4,016,621 A * 4/1977 Slegers et al. ..... 15/104.062
4,056,474 A 11/1977 Snouffer
4,160,478 A 7/1979 Calhoun et al.
4,722,794 A 2/1988 Duncan
6,182,752 B1 2/2001 Smith et al.

FOREIGN PATENT DOCUMENTS

WO 2010/127801 11/2010

OTHER PUBLICATIONS

For the American Heritage Dictionary definition: right. (n.d.) The American Heritage® Dictionary of the English Language, Fourth Edition. (2003). Retrieved Aug. 8, 2014 from http://www.thefreedictionary.com/right.*
For the American Heritage Dictionary definition: align. (n.d.) The American Heritage® Dictionary of the English Language, Fourth Edition. (2003). Retrieved Aug. 8, 2014 from http://www.thefreedictionary.com/align.*
Office Action for Canadian Patent Application No. 2,770,088 dated Aug. 28, 2013.

* cited by examiner

*Primary Examiner* — David Andrews
*Assistant Examiner* — Wei Wang
(74) *Attorney, Agent, or Firm* — Nelson Mullins Riley & Scarborough, LLP

(57) ABSTRACT

A ball drop wellhead control apparatus provides a ball controller between a frac ball drop or frac ball injector used to drop frac balls into a frac fluid stream being pumped into a subterranean well.

14 Claims, 6 Drawing Sheets

BALL DROP WELLHEAD CONTROL APPARATUS

FIELD OF THE INVENTION

This invention relates in general to hydrocarbon well stimulation equipment and, in particular, to a ball drop wellhead control apparatus that provides a ball controller between a frac ball drop or frac ball injector and a stimulation fluid stream that is being pumped into a hydrocarbon well.

BACKGROUND OF THE INVENTION

Current methods for completing hydrocarbon wells often involve pumping fracturing fluids into several production zones of a well. In order to improve efficiency of this process, ball-actuated frac sleeves were invented. The ball-actuated frac sleeve has side ports that block fluid access to a production zone with which it is associated until an appropriately sized frac ball is pumped down from the surface to open the sleeve. The frac ball lands on a seat in the ball-actuated frac sleeve and frac fluid pressure on the frac ball forces the side ports in the frac sleeve to open and provide fluid access to that production zone.

Although frac balls can be dropped through a surface valve, this is a slow process that is a danger to operators if any mistake is made. Consequently, mechanisms for dropping or injecting frac balls in an appropriate size sequence into a frac fluid stream have been invented. However, such mechanisms are subject to mechanical failure and/or operator error. As is well understood, a frac ball dropped out of sequence is very undesirable because one or more zones are not fractured and the ball-actuated sleeves associated with those zones are left closed, so expensive remediation is required.

There therefore exists a need for a ball drop wellhead control apparatus that provides a ball controller between a frac ball drop or frac ball injector and a stimulation fluid stream that is being pumped into a hydrocarbon well.

SUMMARY OF THE INVENTION

It is therefore an object of the invention to provide a ball drop wellhead control apparatus that provides a ball controller between a frac ball drop or frac ball injector and a stimulation fluid stream that is being pumped into a hydrocarbon well.

The invention therefore provides a ball drop wellhead control apparatus, comprising: a control body having a central passage; a ball controller housed by the control body and obstructing the central passage, the ball controller providing fluid communication through the central passage when the ball controller is in a ball receiving position, but inhibiting any frac ball dropped from a frac ball drop or a frac ball injector connected directly or indirectly to the control body from being released from the central passage until the ball controller is moved to a ball release position; and an actuator that moves the ball controller from the ball receiving position to the ball release position.

The invention further provides a ball drop wellhead control apparatus, comprising: a control body adapted to be mounted below a frac ball drop or a frac ball injector so that any frac balls released from the frac ball drop or the frac ball injector enter a central passage of the control body before the frac balls can enter a frac fluid stream being pumped into a well; a ball controller housed by the control body and obstructing the central passage, the ball controller providing fluid communication through the central passage between the fluid stream and the frac ball drop or the frac ball injector when the ball controller is in a ball receiving position, while inhibiting any frac ball dropped from the frac ball drop or the frac ball injector from being released from the central passage until the ball controller is moved to a ball release position; and, an actuator adapted to move the ball controller from the ball receiving position to the ball release position.

The invention yet further provides a ball drop wellhead control apparatus, comprising: a control body adapted to be mounted in a frac stack below a frac ball drop or a frac ball injector such that all frac balls released from the frac ball drop or the frac ball injector enter a central passage of the control body; a ball controller housed by the control body and obstructing the central passage, the ball controller enabling fluid communication between a fluid stream being pumped through the frac stack and into a well and the frac ball drop or the frac ball injector when the ball controller is in a ball receiving position in which the frac balls are received in a ball pocket that prevents any frac ball dropped from the frac ball drop or the frac ball injector from being released from the central passage until the ball controller is moved to a ball release position in which the frac ball is released through a ball release port from the ball pocket; and a hydraulic actuator adapted to move the ball controller from the ball receiving position to the ball release position.

BRIEF DESCRIPTION OF THE DRAWINGS

Having thus generally described the nature of the invention, reference will now be made to the accompanying drawings, in which.

DETAILED DESCRIPTION OF THE PREFERRED EMBODIMENTS

The invention provides a ball drop wellhead control apparatus that permits an operator to verify that only a correct ball has been dropped from a ball drop or a ball injector before the ball is released into a fracturing fluid stream being pumped into a well. Consequently, any malfunction of the ball drop or ball injector or operator error that results in a ball being dropped out of sequence, or too many balls being dropped at one time, can be prevented from impacting downhole conditions. Thus, the cost of expensive remediation can be avoided.

Figure 1:
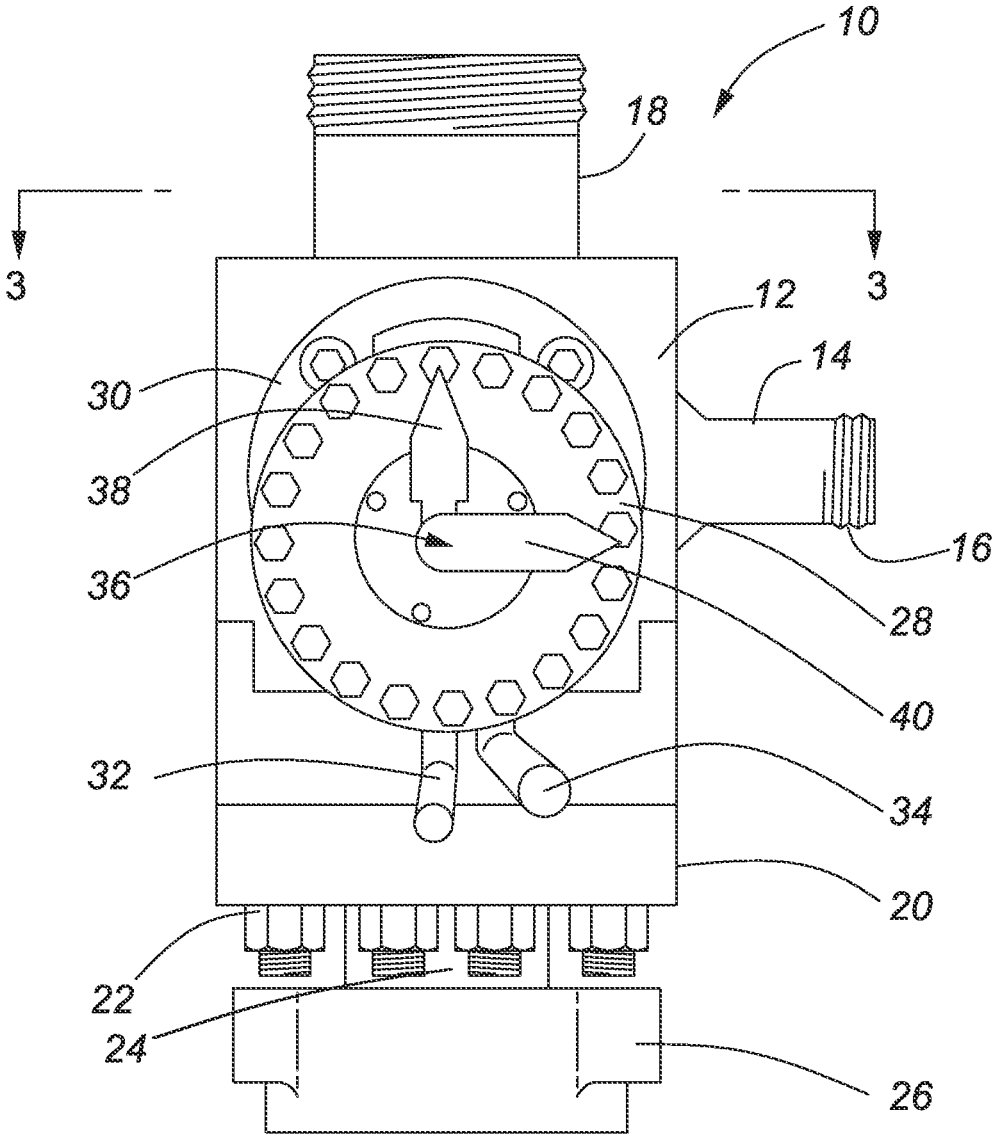
FIG. 1 is a schematic front elevational diagram of one embodiment of a ball drop wellhead control apparatus in accordance with the invention.
Figure 6:
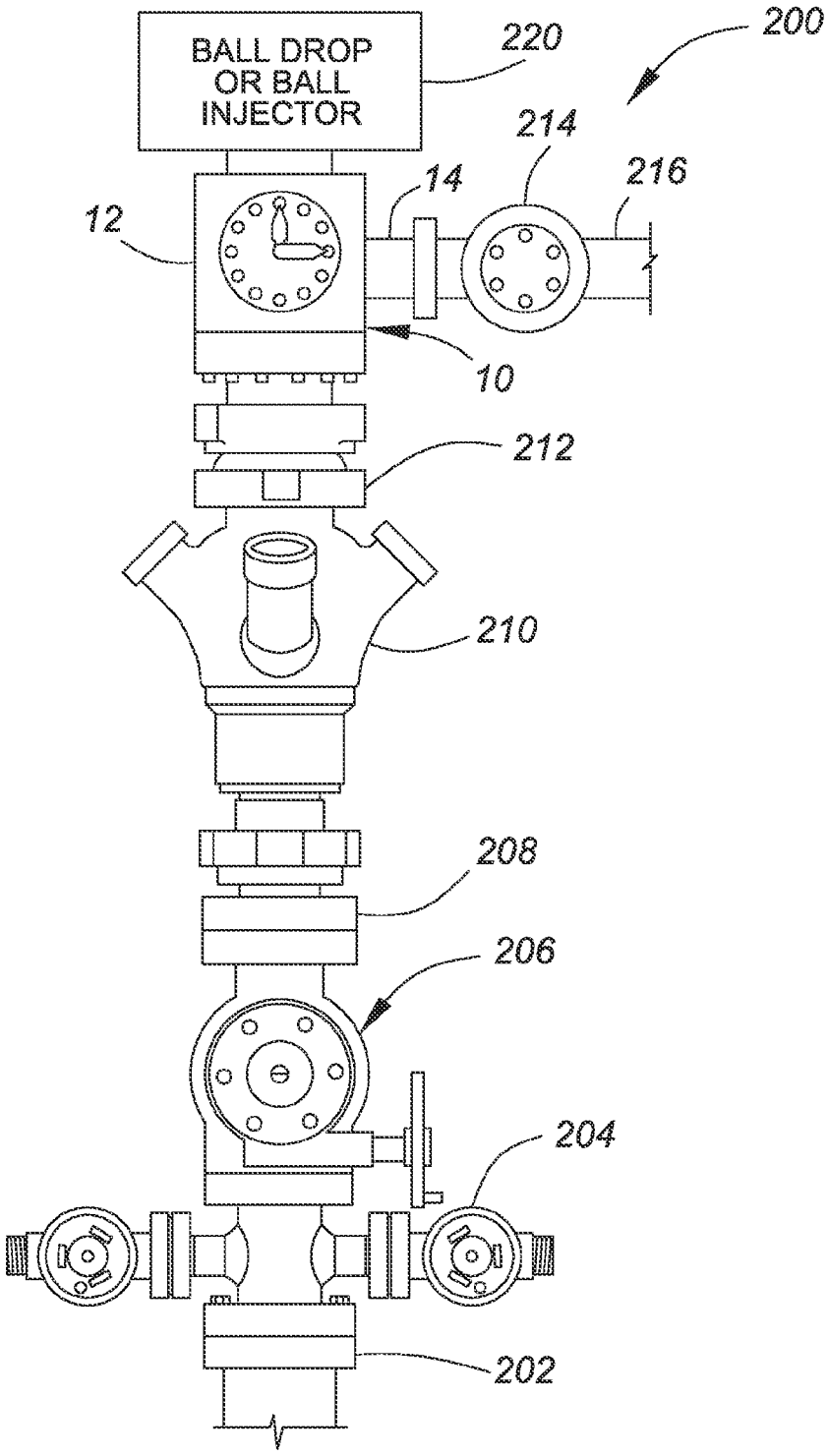
FIG. 6 is a schematic diagram of the ball drop wellhead control apparatus in accordance with the invention mounted in an exemplary frac stack.

FIG. 1 is a schematic elevational diagram of one embodiment of the ball drop wellhead control apparatus 10 in accordance with the invention. The ball drop wellhead control apparatus 10, hereinafter referred to as control apparatus 10, includes a control body 12 with an injection port 14 that terminates in an injection adapter 16. The injection adapter 16 permits the connection of a frac iron to the control apparatus 10 to allow fracturing fluid to be pumped into the control apparatus 10, the purpose of which will be explained below with reference to FIG. 6. This embodiment of the control apparatus 10 is provisioned with quick-disconnect threaded unions described in assignee's U.S. Pat. No. 7,484,776 which issued Feb. 3, 2009, the specification of which is incorporated herein by reference. A male component 18 of the threaded union is welded to a top of the control body 12. The male component 18 is used to mount a ball drop, a ball injector or an adapter used to mount a ball drop or a ball injector to the control apparatus 10, as shown in FIG. 6. A flange 20 bolted to a bottom end of the control body 12 by a plurality of flange studs 22 retains a female component of a threaded union which supports a hammer nut 26, as explained in the assignee's above-referenced patent. The female component 24 and the hammer nut 26 are used to connect the control apparatus 10 to a frac head or the like, as will also be explained below with reference to FIG. 6.

In this embodiment, the control apparatus 10 is operated using a hydraulic actuator 28 that is mounted to the control body 12 by a mounting plate 30. A pair of hydraulic ports 32, 34 permits the connection of hydraulic lines that supply pressurized hydraulic fluid to the hydraulic actuator 28. In this embodiment, the hydraulic actuator 28 is a 90° actuator. A positive indication of a position of the hydraulic actuator 28 is provided by a position indicator 36. The position indicator 36 has a big hand 38 and a little hand 40. The big hand 38 is aligned with an axis of a ball pocket 102 of a ball controller 100 (see FIG. 3). The little hand 40 is aligned with an axis of a ball release port 104 of the ball controller 100 (see FIG. 4). Consequently, an operator can visually confirm whether the ball controller 100 of the control apparatus 10 is in a ball receiving position shown in FIG. 3, in which the big hand 38 points up, or a ball release position shown in FIG. 4, in which the little hand 40 points down.

Figure 2:
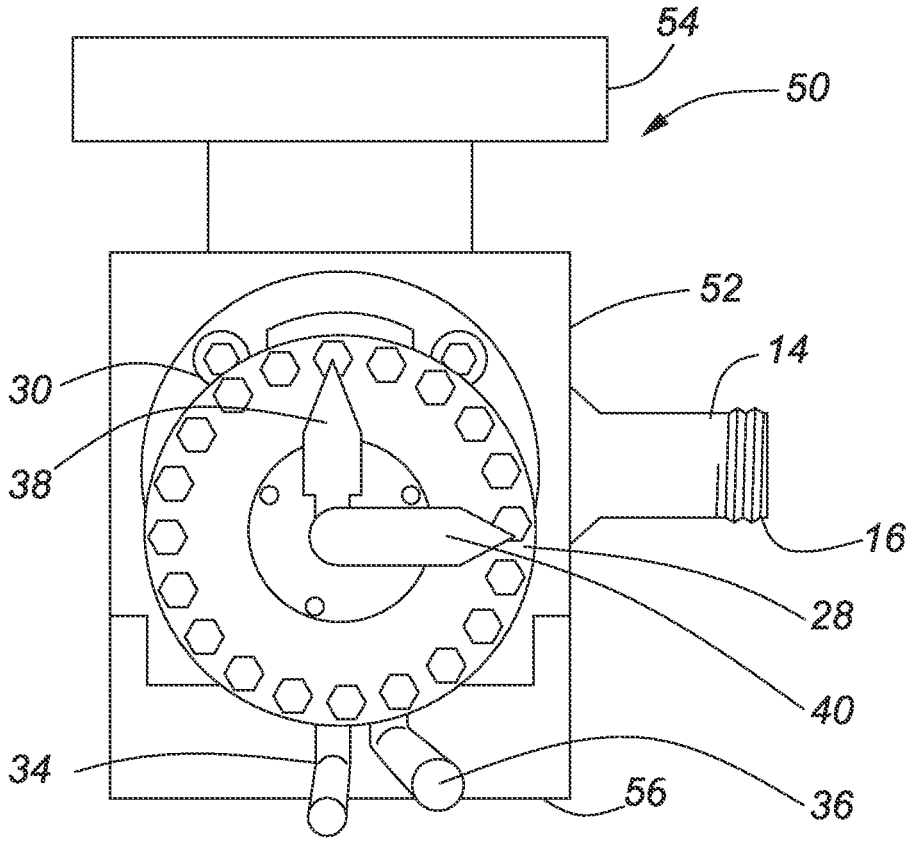
FIG. 2 is a schematic front elevational diagram of another embodiment of a ball drop wellhead control apparatus in accordance with the invention.

FIG. 2 is a schematic elevational diagram of another embodiment of a ball drop wellhead control apparatus 50 in accordance with the invention. The control apparatus 50 has a control body 52. A top end of the control body 52 terminates in an American Petroleum Institute (API) flange 54 used for a bolted connection to a frac ball drop or a frac ball injector using flange bolts in a manner well known in the art. A bottom end 56 of the control body 52 terminates in an API stud pad, also constructed in a manner well known in the art. It should be noted that the bottom end 56 may likewise be provisioned with an API flange (not shown). In all other respects the control body is identical to the control body 10 described above with reference to FIG. 1.

Figure 3:
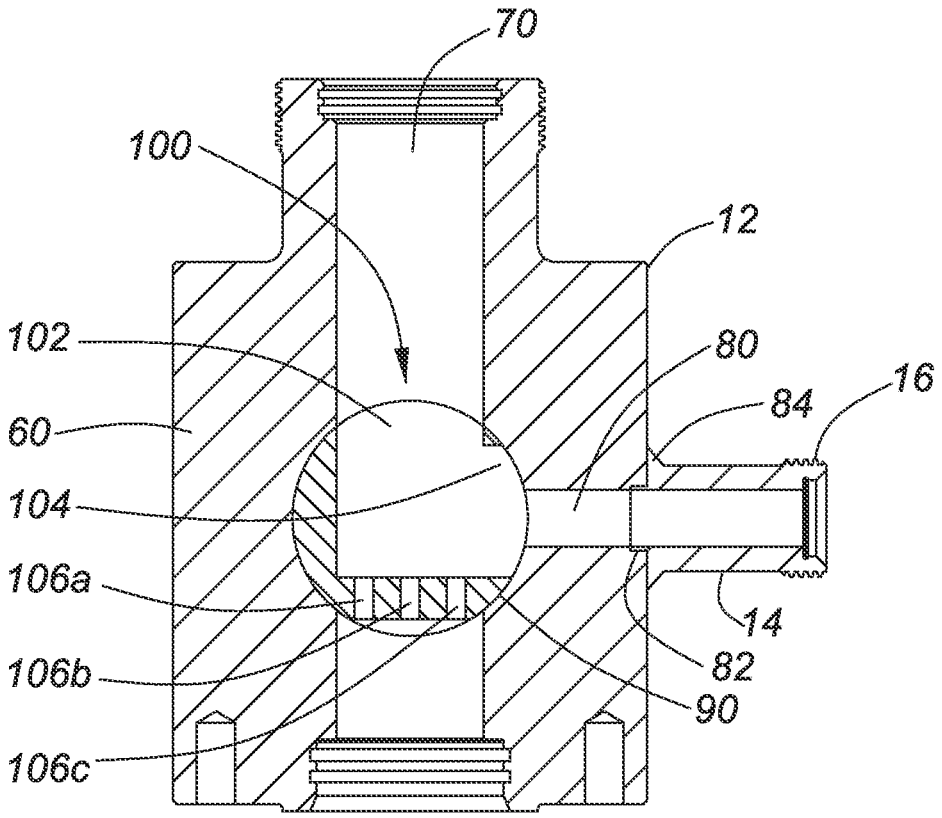
FIG. 3 is a schematic cross-sectional diagram of the ball drop wellhead control apparatus shown in FIG. 1 in a ball receiving position.

FIG. 3 is a schematic cross-sectional diagram of the control body 12 taken along lines 3-3 shown in FIG. 1 with the ball controller 100 in the ball receiving position. The control body 12 has a sidewall 60 with a yield strength adequate to withstand frac fluid pressures, e.g. up to at least 15,000 psi. A central passage 70 of the control body 12 is larger than a diameter of a largest frac ball to be dropped into a well. An injection bore 80 intercepts the central passage 70 at a right angle. The injection port 14 is received in an injection port bore 82 that is concentric with the injection bore 80 and welded to the control body 12 at weld 84. A cylindrical cavity 90 aligned with the central passage 70 receives the ball controller 100. The ball controller has the ball pocket 102 and the ball release port 104. A plurality of through bores 106*a*, 106*b* and 106*c* provide fluid communication between the central passage 70 below the ball controller 100 and the central passage 70 above the ball controller 100. This ensures that a ball drop or a ball injector mounted to the control apparatus 10 is exposed to frac fluid pressure, and further ensures that the ball controller 100 is free to rotate within the cylindrical cavity 90 since it is pressure balanced on both sides.

Figure 4:
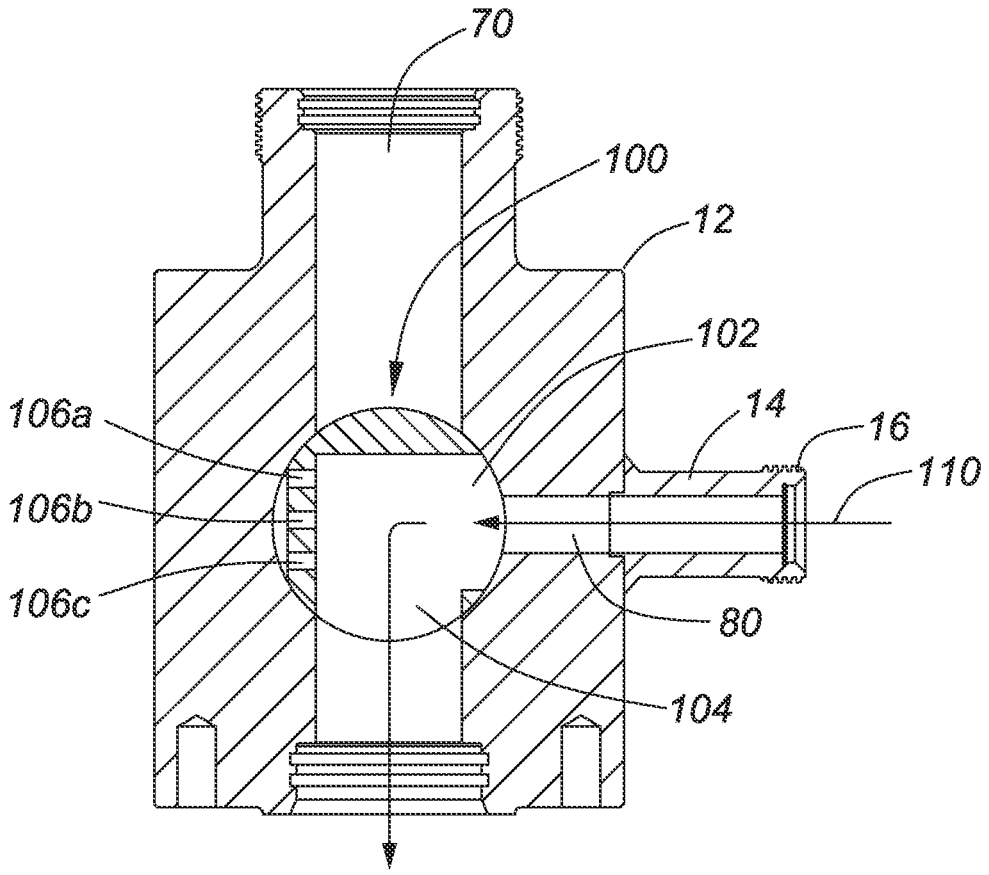
FIG. 4 is a schematic cross-sectional diagram of the ball drop wellhead control apparatus shown in FIG. 1 in a ball release position.

As shown in FIG. 3, the ball controller is in the ball receiving position so that any ball(s) dropped by a ball drop or a ball injector mounted to the control apparatus 10, 50 is propelled by gravity into the ball pocket 102, but cannot fall into a fracturing fluid stream being pumped into a well until an operator operates the control apparatus 10, 50 to move the ball controller to the ball release position shown in FIG. 4.

FIG. 4 is a schematic cross-sectional diagram of the control apparatus 10 shown in FIG. 1 with the ball controller 100 in the ball release position. In this position the ball controller has been rotated 90° clockwise by the actuator 28 so that the ball pocket 102 is aligned with the injection bore 80 and the ball release port 104 is aligned with the central passage 70 below the ball controller 100. In the ball release position, fracturing fluid 110 is optionally pumped for a short period of time through the injection port 14 to drive the frac ball (not shown) downward into a fracturing fluid stream being pumped into the well. The flow of fracturing fluid through the injection port 14 is preferably controlled by an appropriately sized high pressure valve, as will be explained below with reference to FIG. 6. After the fracturing fluid flow through the injection port is stopped, the actuator 28 is operated to move the ball controller back to the ball receiving position shown in FIG. 3.

Figure 5A:
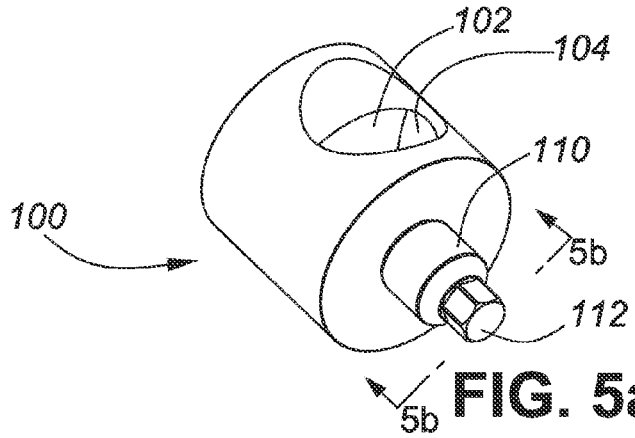
FIG. 5*a* is an isometric view of a ball controller of the ball drop wellhead control apparatus shown in FIGS. 1 and 2.

FIG. 5*a* is an isometric view of a ball controller 100 of the control apparatus 10, 50 shown in FIGS. 1 and 2. The ball controller 100 has a stem end 110 with a stem 112 that is engaged by the actuator 28 to move the ball controller 100 from the ball receiving position shown in FIG. 3 to the ball release position shown in FIG. 4, and back again. The ball controller 100 also has a bearing end 114 (see FIG. 5*b*) that is received in a needle bearing, a bushing, or the like in a manner well known in the art to support the ball controller 100 for rotation within the cylindrical cavity 90. As seen in FIG. 5*a*, in this embodiment the ball pocket 102 and the ball release port 104 are circular bores.

Figure 5B:
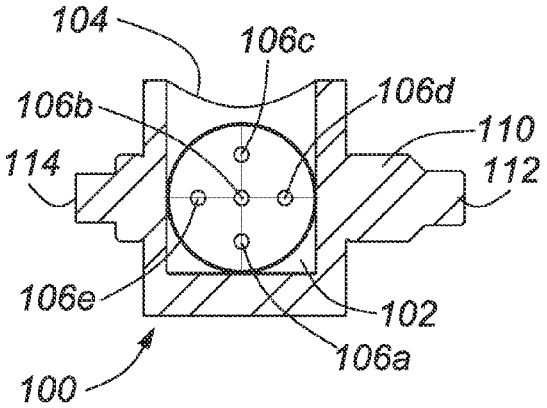
FIG. 5*b* is a cross-sectional view taken along lines 5*b*-5*b* of the ball controller shown in FIG. 5*a;*

FIG. 5*b* is a cross-sectional view taken along lines 5*b*-5*b* of the ball controller shown in FIG. 5*a*. In this embodiment the bottom of the ball pocket 102 includes 5 through bores 106*a*, 106*b*, 106*c*, 106*d* and 106*e*. It should be understood that the size, position and number of through bores is a matter of design choice. The only known limitation is that the through bores 106 must be smaller in diameter than an outside diameter (OD) of the smallest ball to be dropped from the ball drop or the ball injector, so that none of the balls to be dropped can pass into the fracturing fluid stream being pumped into the well unless the ball controller is moved from the ball receiving position shown in FIG. 3 to the ball release position shown in FIG. 4

Figure 5C:
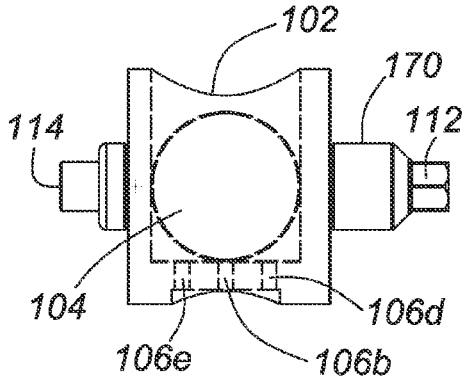
FIG. 5*c* is a left side elevational view of the ball controller shown in FIG. 5*a;*

FIG. 5*c* is a left side elevational view of the ball controller 100 shown in FIGS. 5*a*-5*b*. The ball release port 104 and the through bores 106*a*, 106*b* and 106*c* are shown in stippled lines.

Figure 5D:
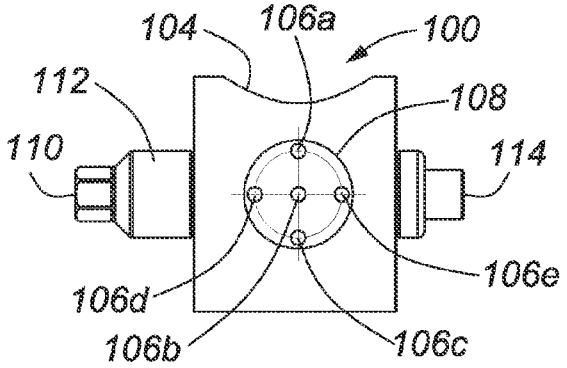
FIG. 5*d* is a bottom plan view of the ball controller shown in FIG. 5*a;*

FIG. 5*d* is a bottom plan view of the ball controller 100 shown in FIGS. 5*a*-5*c*. In this embodiment a shallow countersink bore 108 is drilled to facilitate the drilling of through bores 106*a*-106*e*.

Figure 5E:
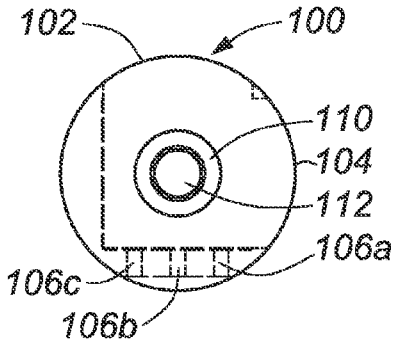
FIG. 5*e* is a stem end elevational view of the ball controller shown in FIG. 5*a*.

FIG. 5*e* is a stem end elevational view of the ball controller 100 shown in FIGS. 5*a*-5*d*.

FIG. 6 is a schematic diagram of the control apparatus 10 shown in FIG. 1 mounted in an exemplary frac stack 200. This frac stack 200 is mounted to a wellhead 202. The frac stack 200 includes a cross-flow tee 204, a high pressure valve 206, and adapter 208, and a frac head 210 to which a plurality of frac irons (not shown) are connected in a manner well known in the art. An adapter 212, a Bowen union for example, is used to connect the control apparatus 10 to the top of the frac head 210. A high pressure valve 214 is connected directly or indirectly to the injection port 14 of the control body 12 to control a flow of fracturing fluid supplied by a frac iron 216 connected to a frac manifold (not shown) in a manner well known in the art. A ball drop or a ball injector 220 is mounted to a top of the control apparatus 10. The ball drop or ball injector 220 may be any one of the frac ball drops or frac ball injectors known in the art.

As explained above, in use a ball is dropped from the ball drop or ball injector 220 at an appropriate time while the ball controller 100 of the control apparatus 10 is in the ball receiving position shown in FIG. 3. Most ball drops and ball injectors have a mechanism for determining which ball(s) were dropped. Once the ball drop or ball injector operator has verified that the correct frac ball, and only the correct frac ball, was dropped the actuator 28 is operated to move the ball controller 100 from the ball receiving position shown in FIG. 3 to the ball drop position shown in FIG. 4. If the wrong ball is dropped, or one or more extra balls are dropped due to a mechanical malfunction or operator error, then the frac job must be stopped, pressure released and the control apparatus 10, 50 must be removed and the ball pocket 102 emptied. Everything can then be reassembled and the fracturing operation may be resumed. Consequently, recovery is relatively quick and inexpensive.

The control apparatus 10, 50 also provides another advantage. It permits frac balls having a diameter less than an internal diameter of the injection port 14 to be injected manually if required. As is well understood in the art, frac balls with a diameter of less than 2" are more fragile and consequently more likely to shatter when they are driven into the seat of a ball-actuated frac sleeve. If a pumping crew does not see the fracturing fluid pressure spike they are expecting after a small frac ball is pumped down, they may request another ball of the same diameter be dropped. This cannot be accomplished by most ball drops or ball injectors. Consequently, the job must be stopped, pressure released, disconnections made and time taken to load the requested frac ball. This request can be readily fulfilled without stopping the frac job using the control apparatus 10, 50 by closing the frac line 216 and manually inserting the requested frac ball using an auxiliary valve (not shown). The requested frac ball is then pumped through the high pressure valve 214 while the ball controller 100 is in the ball release position shown in FIG. 4.

Although the control apparatus 10, 50 have been described with reference to a hydraulic actuator 28, it should be understood that many other control mechanisms could be used for the same purpose, including a stepper motor, a hydraulic motor, or any other power source capable of reliably moving the ball controller 100 from the ball receiving position to the ball release position, and back again.

The scope of the invention is therefore intended to be limited solely by the scope of the appended claims.

I claim:

1. A ball drop wellhead control apparatus, comprising:

a control body having a central passage;

a ball controller housed by the control body and obstructing the central passage, the ball controller having a ball pocket that is aligned with the central passage of the control body when the ball controller is in the ball receiving position, at least one through bore in a bottom of the ball pocket that provides fluid communication through the ball controller when the ball controller is in a ball receiving position, and a ball release port through which a frac ball is released from the ball pocket when the ball controller is in a ball release position, the ball release port being oriented at a right angle with respect to the ball pocket, the ball controller inhibiting any frac ball dropped from a frac ball drop or a frac ball injector connected directly or indirectly to the control body from being released from the central passage until the ball controller is moved to the ball release position; and an actuator that moves the ball controller from the ball receiving position to the ball release position.

2. The ball drop wellhead control apparatus as claimed in claim 1 further comprising an injection port in a sidewall of the control body, the injection port being aligned with the ball pocket and the ball release port being aligned with the central passage below the ball controller when the ball controller is in the ball release position.

3. The ball drop wellhead control apparatus as claimed in claim 2 wherein the injection port is aligned with the ball release port when the ball controller is in the ball receiving position.

4. The ball drop wellhead control apparatus as claimed in claim 2 further comprising an injection adapter connected to the injection port to permit a frac iron to be connected to the injection port to permit frac fluid to be pumped into the ball pocket when the ball controller is in the ball release position.

5. The ball drop wellhead control apparatus as claimed in claim 1 wherein the ball controller is a cylindrical plug having a stem end that extends through a sidewall of the control body.

6. The ball drop wellhead control apparatus as claimed in claim 5 wherein the actuator comprises a 90° hydraulic actuator connected to the stem end of the cylindrical plug.

7. The ball drop wellhead control apparatus as claimed in claim 6 further comprising a position indicator connected to the hydraulic actuator that provides a visual indication of whether the ball controller is in the ball receiving position or the ball release position.

8. A ball drop wellhead control apparatus, comprising:

a control body adapted to be mounted below a frac ball drop or a frac ball injector so that any frac balls released from the frac ball drop or the frac ball injector enter a central passage of the control body before the frac balls can enter a frac fluid stream being pumped into a well;

a ball controller housed by the control body and obstructing the central passage, the ball controller comprising a ball pocket that is aligned with the central passage of the control body when the ball controller is in the ball receiving position, at least one through bore that provides fluid communication between the central passage below the ball controller and the central passage above the ball controller, the at least one through bore having a smaller internal diameter than an outer diameter of a smallest frac ball to be dropped by the frac ball drop or the frac ball injector, and a ball release port oriented at a right angle with respect to the ball pocket, through which the frac ball is released from the ball pocket when the ball controller is in the ball release position, the ball controller inhibiting any frac ball dropped from the frac ball drop or the frac ball injector from being released from the central passage until the ball controller is moved to a ball release position; and an actuator adapted to move the ball controller from the ball receiving position to the ball release position.

9. The ball drop wellhead control apparatus as claimed in claim 8 further comprising an injection port in a sidewall of the control body, the injection port being aligned with the ball pocket when the ball controller is in the ball release position, and the injection port is aligned with the ball release port when the ball controller is in the ball receiving position.

10. The ball drop wellhead control apparatus as claimed in claim 9 further comprising an injection adapter connected to the injection port to permit frac fluid to be pumped into the ball pocket when the ball controller is in the ball release position.

11. The ball drop wellhead control apparatus as claimed in claim 8 wherein the ball controller is a cylindrical plug having a stem end that extends through a sidewall of the control body, and the ball controller actuator comprises a hydraulic actuator connected to the stem end of the cylindrical plug.

12. The ball drop wellhead control apparatus as claimed in claim 11 further comprising a position indicator connected to the hydraulic actuator that provides a visual indication of whether the hydraulic actuator has the ball controller in the ball receiving position or the ball release position.

13. A ball drop wellhead control apparatus, comprising:

a control body adapted to be mounted in a frac stack below a frac ball drop or a frac ball injector such that all frac balls released from the frac ball drop or the frac ball injector enter a central passage of the control body;

a ball controller housed by the control body and obstructing the central passage, the ball controller comprising a ball pocket that is aligned with the central passage of the control body above the ball controller when the ball controller is in a ball receiving position, and a ball release port that is oriented at a right angle with respect to the ball pocket, the frac balls being released from the ball pocket through the ball release port only when the ball controller is in a ball release position in which the ball release port is aligned with the central passage below the ball controller, the ball controller enabling fluid communication between a fluid stream being pumped through the frac stack and into a well and the frac ball drop or the frac ball injector when the ball controller is in the ball receiving position; and a hydraulic actuator adapted to move the ball controller from the ball receiving position to the ball release position.

14. The ball drop wellhead control apparatus as claimed in claim 13 further comprising a position indicator that provides a visual indication of whether the ball controller is in the ball receiving position or the ball release position.

* * * * *